US005310243A

United States Patent [19]

Pine

[11] Patent Number: 5,310,243

[45] Date of Patent: May 10, 1994

[54] HEADREST SUPPORT ASSEMBLY FOR RECLINER CHAIR

[75] Inventor: James J. Pine, Tupelo, Miss.

[73] Assignee: DBJU, Inc., Verona, Miss.

[21] Appl. No.: 37,409

[22] Filed: Mar. 26, 1993

[51] Int. Cl.[5] ..... A47C 1/037

[52] U.S. Cl. ..... 297/61; 297/403

[58] Field of Search ..... 297/61, 403

[56] References Cited

U.S. PATENT DOCUMENTS

| | | | |
|---|---|---|---|
| 369,558 | 9/1887 | Scarritt et al. . | |
| 2,884,992 | 5/1959 | Spound et al. . | |
| 2,975,826 | 3/1961 | Spound et al. . | |
| 2,984,293 | 5/1961 | Bontempi et al. . | |
| 2,996,332 | 8/1961 | Kurtyka et al. . | |
| 3,074,758 | 1/1963 | Schliephacke . | |
| 3,132,894 | 5/1964 | Schliepocke | 297/61 |
| 3,140,117 | 7/1964 | Fletcher . | |
| 3,844,607 | 10/1974 | Ré | 297/61 |
| 3,847,430 | 11/1974 | Fletcher | 297/61 |
| 3,865,432 | 2/1975 | Rogers, Jr. et al. | 297/61 X |
| 3,871,705 | 3/1975 | Harrison | 297/61 |
| 4,188,062 | 2/1980 | Rogers, Jr. et al. . | |
| 4,451,081 | 5/1984 | Kowalski . | |
| 5,129,701 | 7/1992 | Pine . | |

*Primary Examiner*—Peter R. Brown

*Attorney, Agent, or Firm*—Watson, Cole, Grindle & Watson

[57] ABSTRACT

A headrest support assembly for a recliner chair includes mirror-image right and left support subassemblies that each include first and second support links that are pivotally connected at their upper ends to mounting brackets that can support a headrest of the chair, and upper and lower swing links that are pivotally connectable to corresponding first ends to the backrest frame of the chair and at corresponding second ends to the first support link. A pin extending from a lower end of the second support link extends in an opening along the length of the upper swing link. An actuator link which is movable by a support carriage of the chair is connected to the lower swing link to cause the links to shift between a retracted condition wherein the supported headrest faces upwardly and a deployed condition wherein the supported headrest faces forwardly of the chair. A spring can be connected between the upper swing link and the lower end of the second support link of each support subassembly to assist in shifting of the respective subassembly into a deployed condition. The opening in the upper swing link of each support subassembly can be slot shaped to enable the support headrest to tilt when the respective support subassembly is in a deployed condition.

13 Claims, 4 Drawing Sheets 13
50
60
40
70
45
90
13
50
60
40
70
45
90

13
50
60
40
45
90
110
90
102
94
101
100

HEADREST SUPPORT ASSEMBLY FOR RECLINER CHAIR

BACKGROUND OF THE INVENTION

1. Field of the Invention

The present invention relates to recliner chairs, and more particularly to headrest support assemblies which can be used in recliner chairs to move and orient a headrest between a retracted (non-use) positioning and a deployed (use) positioning when the chair is shifted between an upright and a reclined state.

2. The Prior Art

Movement chairs such as recliner and incliner chairs which include headrest support assemblies that can move supported headrests between retracted and deployed positionings when the chairs are shifted between upright and reclined states are well known. See, for example, U.S. Pat. Nos. 369,558, 2,884,992, 2,975,826, 2,984,293, 2,996,332, 3,074,758, 3,140,117, 4,188,062 and 4,451,081. However, the known headrest support assemblies either operate to swing the headrests from a position within the backrest frame to a position above the frame by following an arc behind the frame, thus necessitating that the chair be located at a relatively large distance from a rearward wall, or they operate to move the headrests upwardly from within the backrest frame through an opening in the top of the backrest frame, which means that the frame will have an exposed opening that will be rather unsightly. Most of the known headrest support assemblies support the associated headrests in a rigid fashion, which means that the headrests cannot move or tilt in a resilient manner upon contact by the head of an occupant. Thus they cannot provide the ultimate in comfort to a user.

It is an object of the present invention to provide a headrest support assembly for a recliner (incliner) chair that is constructed such that when in a retracted condition, it will support the headrest in a position over the top of the backrest frame of the chair (thus covering the opening constructed therein) and facing upwardly, and when in a deployed condition, will support the headrest in a position spaced above and forwardly of the top end of the backrest frame and reoriented so as to face forwardly of the chair.

It is a further object of this invention to provide such a headrest support assembly which includes a spring means to assist in shifting the headrest support assembly into a deployed condition.

It is a still further object of this invention to provide a headrest support assembly which, when deployed, can movably (tiltably) support the headrest such that it will resiliently tilt upon rearward pressure applied by the head of an occupant.

It is a still further object of this invention to provide a headrest support assembly which is useable with the double-shift carriage mechanism for a full recline incliner chair as disclosed in my U.S. Pat. No. 5,129,701.

SUMMARY OF THE INVENTION

According to the present invention the headrest support assembly includes mirror image right and left support subassemblies respectively attachable to opposite sides of the frame of a recliner (incliner) chair, each of the support subassemblies including, a mounting bracket to which the headrest can be attached, a first support link pivotally connected at its upper end to the mounting bracket, upper and lower swing links connected at first corresponding ends to an associated side of the backrest frame and at corresponding second ends to the first support link, the upper swing link including an opening therein along its length, a second support link pivotally connected at its upper end to the mounting bracket and including a pin which extends through the opening in the upper swing link, and an actuator link connected at its upper end to one of the upper and lower swing links and connectable at its lower end to a shiftable carriage mechanism of the recliner chair, movement of the actuator link by the shiftable carriage mechanism causing the headrest support assembly to shift between retracted and deployed conditions.

In a preferred embodiment a spring means is connected between the upper swing link and a lower end of the second support link of each support subassembly to assist in shifting the support subassembly into a deployed condition. In a related preferred embodiment the opening in the upper swing link is formed as a slot, such that the pin of the second support link which extends therein can move therealong, the spring means connected between the upper swing link and the lower end of the second support link enabling the supported headrest to resiliently tilt upon the application of rearward pressure thereagainst by the head of a user.

The right and left support subassemblies are constructed such that the headrest support assembly, when in a retracted condition, will position the supported headrest on top of the backrest frame and oriented to face upwardly, whereas when in a deployed condition it will position the supported headrest above and forwardly of the backrest frame and reoriented to face forwardly (about a 90° reorientation). In a preferred embodiment the headrest support assembly will allow the headrest, when in a deployed condition, to tilt in a resilient manner upon contact by the head of an occupant.

Further features and advantages of the invention will become apparent with reference to the attached drawings and the following discussion.

DETAILED DESCRIPTION OF THE PREFERRED EMBODIMENT

Figure 1:
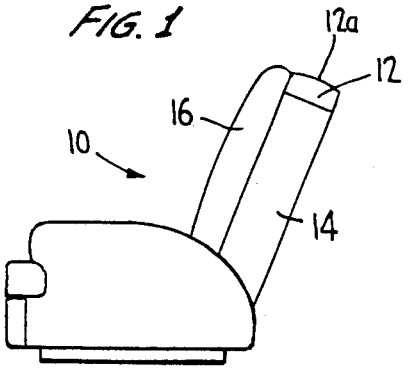
FIG. 1 is a schematic side view of a full recline incliner chair which includes a headrest support assembly according to a preferred embodiment of the present invention, the chair being in an upright state and its headrest support assembly in a retracted condition.
Figure 2:
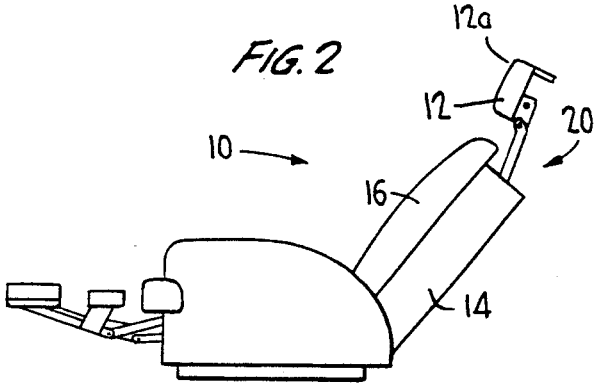
FIG. 2 is a schematic side view of the full recline incliner chair of FIG. 1 when in an inclined state, its headrest support assembly being in a deployed condition.

A full recline incliner chair which incorporates a headrest support assembly according to a preferred embodiment of the present invention is schematically shown in FIGS. 1 and 2. In FIG. 1 the chair 10 is in an upright state and its headrest 12, which is mounted on the headrest support assembly located in the backrest frame 14, is positioned behind the backrest 16 and at the upper end of the backrest frame 14. Its contact surface 12*a* faces upwardly. In FIG. 2 the chair is in an inclined (T.V.) state, and the headrest 12 is located in a use positioning at a distance above and forwardly of the backrest frame 14 (above the backrest 16) and it has become reoriented by the inventive headrest support assembly 20 such that its contact surface 12*a* faces forwardly.

Figure 3:
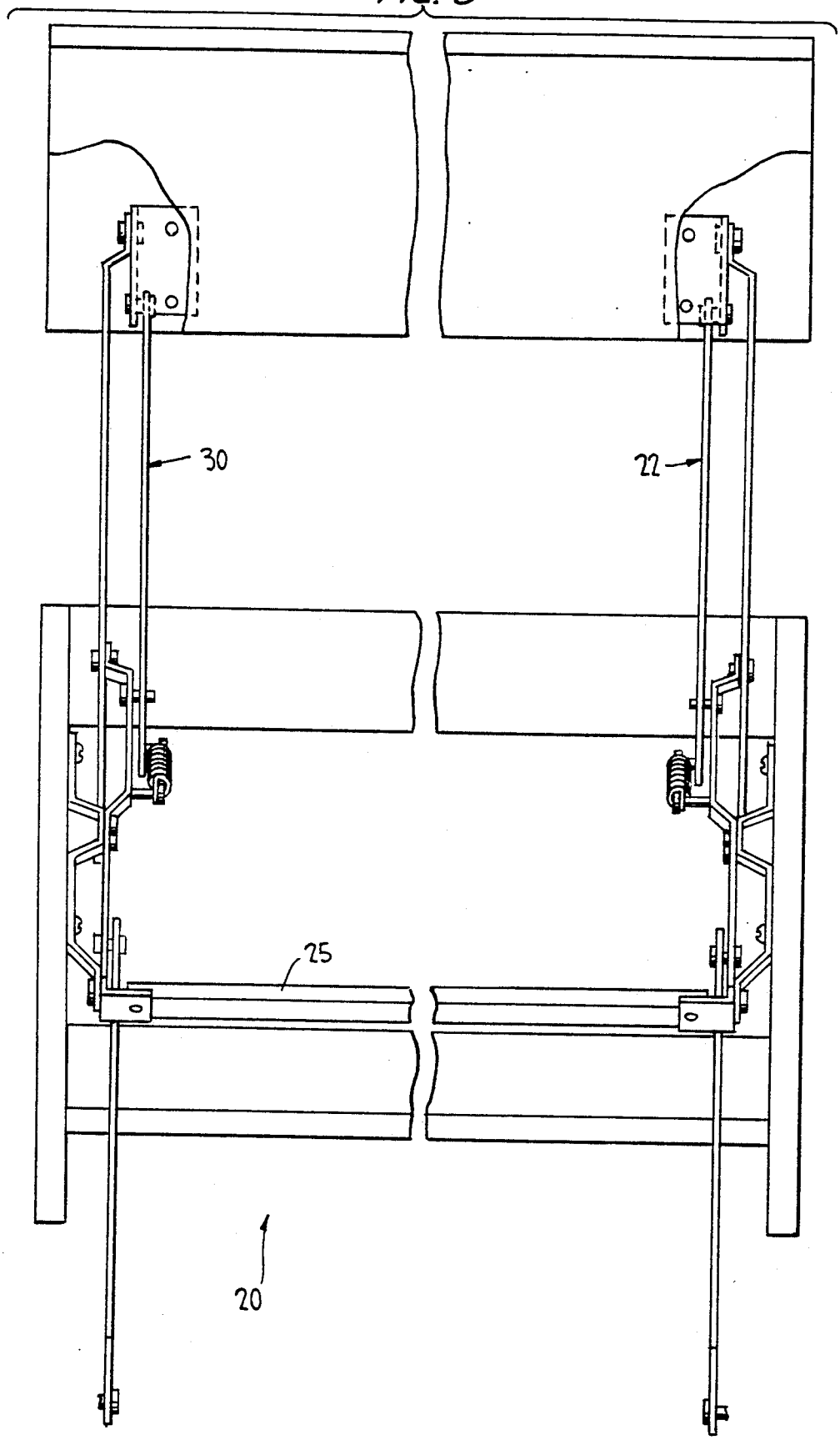
FIG. 3 shows a top plan view of the inventive headrest support assembly when in its deployed condition.

As can be seen from FIG. 3, the headrest support assembly 20 includes a left support subassembly 22 and a right support subassembly 30. A cross bar 25 is interconnected therebetween. The left support subassembly is constructed to be a mirror image of the right support subassembly, such that a description of the right support subassembly will suffice to describe the left subassembly. In the following description of the right support subassembly 30, the terms outer and outwardly will relate to a location or side opposite (facing or extending away from) the left support subassembly 22 and the terms inner or inwardly will relate to a location or side towards (facing or extending towards) the left support subassembly 22, while the terms front, rear, top and bottom will relate to an orientation relative to the front, rear, top and bottom of the chair 10.

Figure 4:
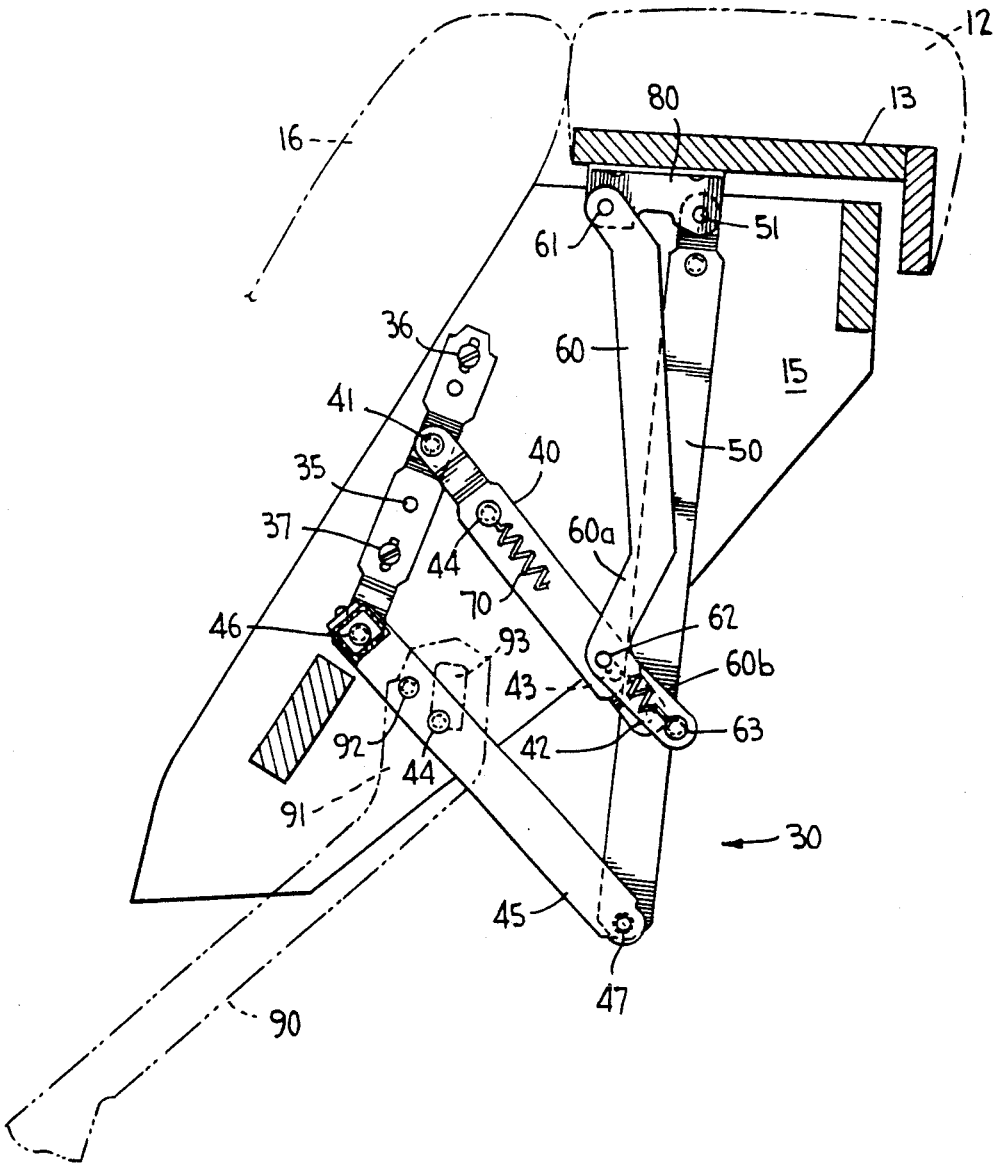
FIG. 4 shows a side elevational view of the right subassembly of the headrest support assembly when in a retracted condition.

Referring to FIG. 4, the right support subassembly 30 is seen to include a mounting link 35 which is attached by screws 36, 37 to the right side board 15 of the backrest frame 114, and upper and lower swing links 40 and 45 which are pivotally connected at their front ends to the mounting link by respective pivot pins 41 and 46. The rear ends of these swing links are pivotally connected by respective pivot pins 42 and 47 to a first support link 50 whose upper end is pivotally connected to the rear end of mounting bracket 80 by a pivot pin 51. The mounting bracket 80 is connected to a headrest support board 13. A second support link 60 is pivotally connected at its upper end to the front end of the mounting bracket 80 by a pivot pin 61. The lower end of the second support link 60 includes non-linear portions 60*a* and 60*b* that provide a V configuration. A pin 62 extends outwardly from the second support link at the intersection of portions 60*a* and 60*b* and extends within an opening 43 shaped as a slot in the upper swing link 40. A mounting pin 63 which extends inwardly from the lower end of the portion 60*b* mounts one end of a coiled spring 70, the opposite end of the spring being connected to a mounting pin 44 which extends inwardly from the upper swing link 40.

Figures 7, 8:
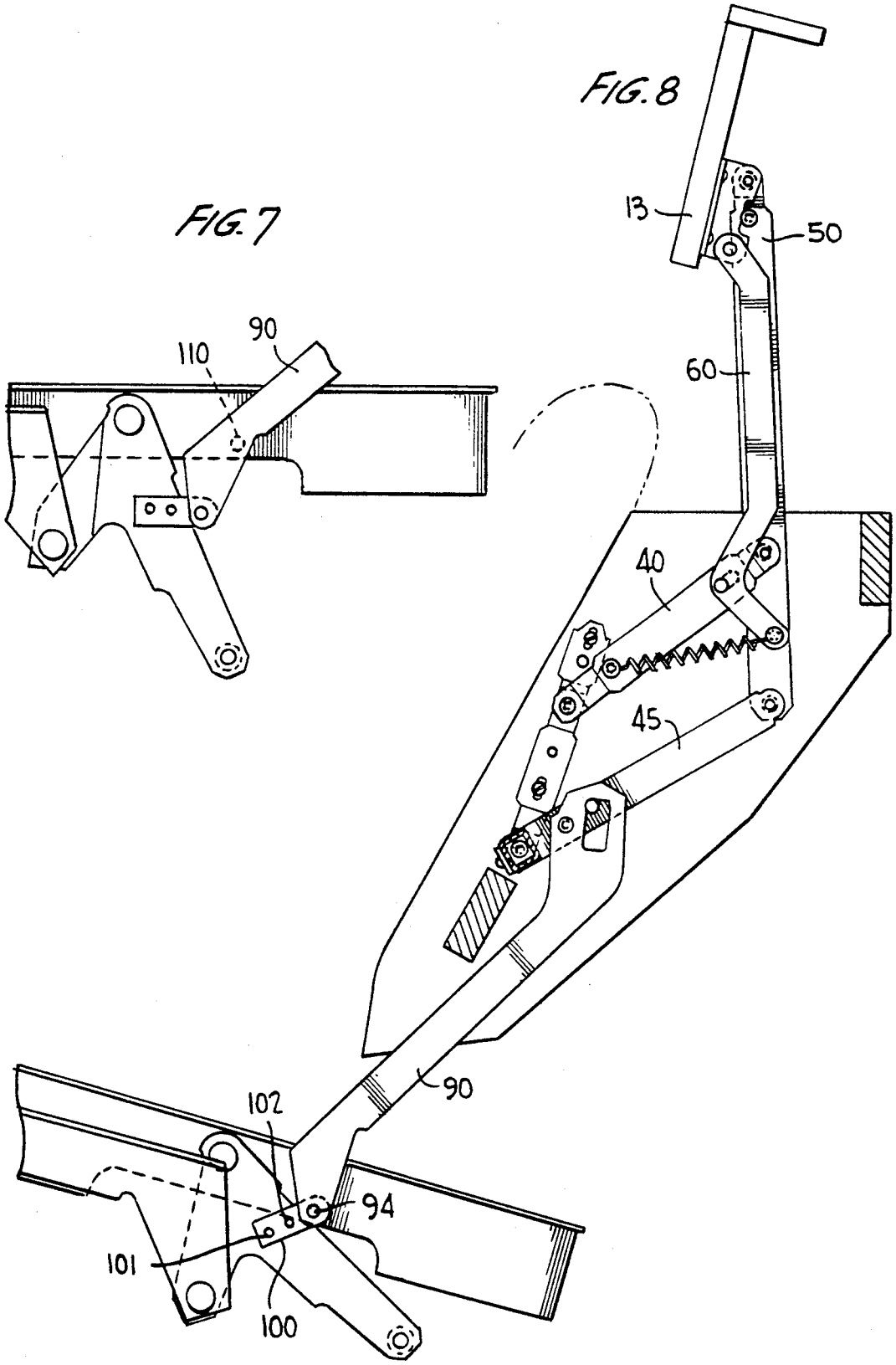
FIG. 7 shows the lower end of the actuator link of the right subassembly and its connection to a double-shift carriage mechanism of the full recline incliner chair when the carriage mechanism is in its retracted condition and the chair is in its upright state (the headrest support assembly is in a retracted condition)
FIG. 8 shows the right subassembly and the carriage mechanism of the chair after the carriage mechanism has become extended to its first shift position and the chair has become inclined, consequently causing the right headrest subassembly, and thus the headrest support assembly as a whole, to become deployed.

The right support subassembly also includes an actuator link 90 which has a head portion 91 at its upper end that is pivotally connected to the lower swing link 45 by a pivot pin 92. The head portion 91 includes a generally rectangular slot 93 in which extends a stop pin 44 that extends inwardly from the lower swing link 45. As seen in FIGS. 7 and 8, the lower end of the actuator link is pivotally connected to a bracket 100 by a pin 94, the bracket being fixedly mounted by bolts 101, 102 to the rear strut member of a right incline frame subassembly of a double-shift carriage mechanism as disclosed in my aforementioned U.S. Pat. No. 5,129,701, the contents of which are herein incorporated by reference.

With the full recline incliner chair in its upright state (FIG. 1) and its double-shift carriage mechanism in its retracted condition (FIG. 7), the inventive headrest support assembly will be in its retracted condition (FIG. 4) and the headrest 12 will be positioned o top of the backrest frame 14 and facing upwardly. When an occupant sitting in the chair causes the double-shift carriage mechanism to shift to its intermediate extended condition (FIG. 8), thus causing the chair to become inclined (FIG. 2), the actuator link 90 will be moved upwardly relative to the backrest frame 14. The upward movement of the actuator link 90 will cause the lower swing link 45 to pivot upwardly about pivot pin 46, which in turn will cause the first support link 50 to move upwardly, and the upper swing link 40 to pivot upwardly about the pivot pin 41. Due to the configuration of the second support link 60 and the fact that its pin 62 is located in the slot 43 of the upper swing link 40, the mounting bracket 80 will tilt around rear pivot pin 51, thereby causing the headrest support board 13 (and thus the headrest 12) to move upwardly of the backrest frame 14 and to reorient about 90° towards the front of the chair. The spring 70 will eventually cause the linkage 40, 45, 50, 60 to shift to a forwardmost position wherein the stop pin 44 of the lower swing link 40 abuts the upper end of the slot 93 in the head of the actuator link 90 (FIG. 8).

Figures 5, 6:
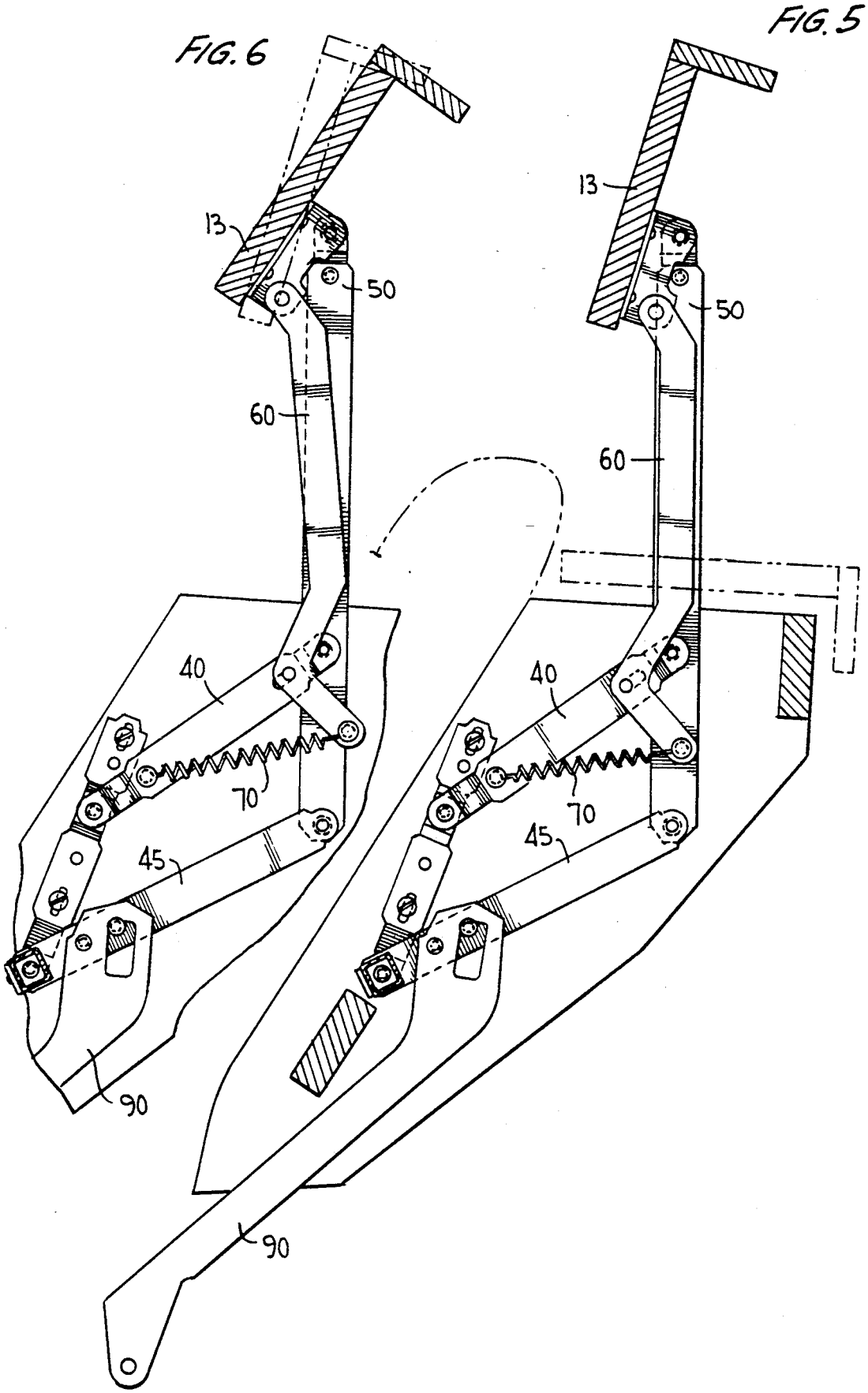
FIGS. 5 and 6 show the right subassembly when in its deployed condition, FIG. 5 depicting the relative positioning of its elements when no external forces act on its headrest support board and FIG. 6 depicting the relative positioning of its elements when the head of a user has caused the headrest support board to tilt.

When the head of an occupant sitting in the chair applies rearward pressure on the headrest 12, the headrest can resiliently tilt about the pivot pin 51 due to the fact that the spring 70 allows the second support link 60 to move relative to the first support link 50, with its pin 62 moving within the slot 47 of the swing link, as shown in FIG. 6.

It should be noted that when the chair is in its inclined (T.V.) state (FIG. 8), the pivot pin 94 will be aligned with the hole 110 (see FIG. 7) where the backrest link is attached to the mounting flange of the carriage mechanism (corresponds to hole 46 in my U.S. Pat. No. 5,129,701), so that as the double-shift carriage mechanism is shifted to its fully extended condition (full reclined state of the chair, not shown), the headrest 12 will retain the same positioning relative to the backrest 16.

The crossbar 25, which is connected at its ends to inwardly extending front flange portions of the lower swing links of the right and left subassemblies 30 and 20, ensures that they will always undergo corresponding movement.

When the inclined chair is returned to its upright state, the actuator link 90, due to movement of the bracket 100, will move downwardly relative to the backrest frame, and elements 45, 40, 50, 60 and 80 will be caused to return to their retracted positioning (FIG. 4).

If the tilt feature of the headrest support assembly is not desired, the opening 43 in the upper swing link of each support subassembly, instead of being slot shaped, can be shaped as a hole. Furthermore, in such an embodiment of headrest support assembly the spring 70 of each support subassembly can be eliminated, along with its function of assisting deployment of the headrest support assembly, and the assembly will otherwise function properly. In addition, the cross bar 25 can be eliminated, along with its function of stabilizing the assembly as a whole.

I claim:

1. A support subassembly for a headrest support assembly for use in a recliner chair that includes a backrest, a backrest frame behind the backrest, a headrest and a carriage mechanism capable of being shifted between a retracted condition and an extended condition, said support subassembly including a mounting bracket to which said headrest can be attached, a first support link pivotally connected at an upper end thereof to said mounting bracket, upper and lower swing links connectable at first corresponding ends to said backrest frame and at corresponding second ends to said first support link, said upper swing link including an opening therein along a length thereof, a second support link pivotally connected at an upper end thereof to said mounting bracket and including a pin which extends through said opening, and an actuator link connected at its upper end to one of said upper and lower swing links and connectable at its lower end to said carriage mechanism so as to cause said support subassembly to deploy when said carriage mechanism is shifted from a retracted condition to an extended condition and to retract when said carriage mechanism is shifted from an extended condition to a retracted condition.

2. A support subassembly according to claim 1, including a spring means connected between said upper swing link and a lower end of said second support link to assist in shifting of the support subassembly to a deployed condition.

3. A support subassembly according to claim 2, wherein said opening in said upper swing link is formed as a slot and said pin of said second support link is movable along said slot to enable said mounting bracket to tilt when said support subassembly is in a deployed condition.

4. A support subassembly according to claim 1, including a mounting link to which said first ends of said upper and lower swing links are pivotally attached and which is attachable to said backrest frame.

5. A support subassembly according to claim 1, wherein said actuator link is pivotally connected to said lower swing link and includes a head portion at its upper end that defines a generally rectangular slot, and wherein said lower swing link includes a stop pin that extends within said generally rectangular slot.

6. A headrest support assembly for a recliner chair that includes a backrest, a backrest frame behind the backrest, a headrest and a carriage mechanism which is capable of shifting between a retracted condition and an extended condition, said headrest support assembly including mirror image right and left support subassemblies which each include a mounting bracket to which said headrest can be attached, a first support link pivotally connected at an upper end thereof to said mounting bracket, upper and lower swing links connected at first corresponding ends to said backrest frame and at corresponding second ends to said first support link, said upper swing link including an opening therein along a length thereof, a second support link pivotally connected at an upper end thereof to the mounting bracket and including a pin which extends through said opening, and an actuator link connected at its upper end to one of said upper and lower swing links and connectable at its lower end to said carriage mechanism so as to cause said support subassembly to deploy when said carriage mechanism is shifted from a retracted condition to an extended condition and to retract when said carriage mechanism is shifted from an extended condition to a retracted condition.

7. A headrest support assembly according to claim 6, including a spring means connected between the upper swing link and the lower end of the second support link of each support subassembly to assist in shifting of the headrest support assembly into a deployed condition.

8. A headrest support assembly according to claim 7, wherein said opening in the upper swing link of each of said right and left support subassemblies is formed as a slot and said pin of the second support link of each of said right and left support subassemblies is moveable along said slot to enable the mounting bracket of each support subassembly to tilt when said support subassemblies are in a deployed condition.

9. A headrest support assembly according to claim 6, including separate mounting links to which the first ends of the swing links of the right and left support subassemblies are pivotally attached, said mounting links being attachable to said backrest frame.

10. A headrest support assembly according to claim 6, wherein the actuator links of each of said right and left support subassemblies are pivotally connected to respective lower swing links and include head portions at their upper ends that define identical, generally rectangular slots, and wherein the lower swing links of the right and left support subassemblies include stop pins that extend within the generally rectangular slots of the respective actuator links.

11. A headrest support assembly according to claim 6, including a cross bar connected between the lower swing links of said right and left support subassemblies.

12. In a recliner chair which includes a backrest, a backrest frame behind the backrest which supports the backrest, a carriage mechanism which is capable of shifting between a retracted condition and an extended condition, a headrest and a headrest support assembly, the improvement wherein said headrest support assembly includes mirror image right and left support assemblies which each include a mounting bracket to which said headrest can be attached, a first support link pivotally connected at an upper end thereof to said mounting bracket, upper and lower swing links connected at first corresponding ends to said backrest frame and at corresponding second ends to said first support link, said upper swing link including an opening therein along a length thereof.

a second support link pivotally connected at an upper end thereof to the mounting bracket and including a pin which extends through said opening, and an actuator link connected at its upper end to one of said upper and lower swing links and connectable at its lower end to said carriage mechanism so as to cause said support subassembly to deploy when said carriage mechanism is shifted from a retracted condition to an extended condition and to retract when said carriage mechanism is shifted from an extended condition to a retracted condition.

13. In a full recline incliner chair which includes a backrest, a backrest frame behind the backrest which supports the backrest, a double-shift carriage mechanism which is capable of shifting between a retracted condition, an intermediate extended (inclined) position and a fully extended (full recline) position, a headrest and a headrest support assembly, the improvement wherein said headrest support assembly includes mirror image right and left support assemblies which each include a mounting bracket to which said headrest can be attached, a first support link pivotally connected at an upper end thereof to said mounting bracket, upper and lower swing links connected at first corresponding ends to said backrest frame and at corresponding second ends to said first support link, said upper swing link including an opening therein along a length thereof, a second support link pivotally connected at an upper end thereof to the mounting bracket and including a pin which extends through said opening, and an actuator link connected at its upper end to one of said upper and lower swing links and connectable at its lower end to said carriage mechanism so as to cause said support subassembly to deploy when said carriage mechanism is shifted from a retracted condition to an intermediate extended condition and to retract when said carriage mechanism is shifted from an intermediate extended condition to a retracted condition.

* * * * *